US007615767B2

(12) United States Patent
Soer et al.

(10) Patent No.: US 7,615,767 B2
(45) Date of Patent: Nov. 10, 2009

(54) RADIATION GENERATING DEVICE, LITHOGRAPHIC APPARATUS, DEVICE MANUFACTURING METHOD AND DEVICE MANUFACTURED THEREBY

(75) Inventors: Wouter Anthon Soer, Nijmegen (NL); Maarten Marinus Johannes Wilhelmus Van Herpen, Heesch (NL)

(73) Assignee: ASML Netherlands B.V., Veldhoven (NL)

( * ) Notice: Subject to any disclaimer, the term of this patent is extended or adjusted under 35 U.S.C. 154(b) by 265 days.

(21) Appl. No.: 11/798,037

(22) Filed: May 9, 2007

(65) Prior Publication Data

US 2008/0277599 A1 Nov. 13, 2008

(51) Int. Cl.
*H05G 2/00* (2006.01)

(52) U.S. Cl. ..... 250/504 R; 250/423 R; 250/428; 250/492.1; 250/493.1

(58) Field of Classification Search ..... 250/423 R, 250/428, 492.1, 493.1, 504 R; 313/150, 313/163, 165, 170, 171, 172
See application file for complete search history.

(56) References Cited

U.S. PATENT DOCUMENTS

| | | | | |
|---|---|---|---|---|
| 3,579,377 | A * | 5/1971 | Schreiner et al. | 427/120 |
| 2002/0070353 | A1* | 6/2002 | Richardson | 250/492.1 |
| 2007/0085044 | A1* | 4/2007 | Hergenhan et al. | 250/504 R |
| 2007/0152175 | A1* | 7/2007 | Moors et al. | 250/493.1 |
| 2008/0006783 | A1* | 1/2008 | Hergenhan et al. | 250/504 R |
| 2008/0137050 | A1* | 6/2008 | Ivanov et al. | 355/53 |
| 2008/0277599 | A1* | 11/2008 | Soer et al. | 250/492.22 |

FOREIGN PATENT DOCUMENTS

| | | | |
|---|---|---|---|
| EP | 1401248 | A2 | 3/2004 |
| GB | 2082954 | A | 3/1982 |
| JP | 2000317737 | A | 11/2000 |
| SU | 518822 | A1 | 6/1976 |
| WO | WO 2008029327 | * | 3/2008 |
| WO | WO 2008029327 | A2 | 3/2008 |

OTHER PUBLICATIONS

International Search Report and Written Opinion issued on Aug. 8, 2008 in corresponding International Application No. PCT/NL2008/050260.

J. Pankert et al., EUV Sources for the Alpha-Tools, Proc. of SPIE vol. 6151, pp. 1-9, (2006).

* cited by examiner

*Primary Examiner*—David A Vanore
*Assistant Examiner*—Michael Maskell
(74) *Attorney, Agent, or Firm*—Pillsbury Winthrop Shaw Pittman LLP

(57) ABSTRACT

A device constructed to generate radiation includes a liquid bath, and a pair of electrodes. At least a part of one of the electrodes is formed by a cable part moveable with respect to the liquid bath. The device also includes an actuator arranged to move the cable part from a liquid-adhering position to an ignition position, and an ignition source configured to trigger a discharge produced radiating plasma from the liquid adherent to the cable part, when the cable part is in the ignition position, by a discharge between the electrodes. The liquid-adhering position is a position for adhering a liquid from the bath to the part of the electrode.

26 Claims, 4 Drawing Sheets

RADIATION GENERATING DEVICE, LITHOGRAPHIC APPARATUS, DEVICE MANUFACTURING METHOD AND DEVICE MANUFACTURED THEREBY

FIELD

The present invention relates to a device constructed to generate radiation, a lithographic apparatus, a device manufacturing method and a device manufactured thereby.

BACKGROUND

A lithographic apparatus is a machine that applies a desired pattern onto a target portion of a substrate. Lithographic apparatus can be used, for example, in the manufacture of integrated circuits (ICs). In that circumstance, a patterning device, such as a mask, may be used to generate a circuit pattern corresponding to an individual layer of the IC, and this pattern can be imaged onto a target portion (e.g. including part of one or several dies) on a substrate (e.g. a silicon wafer) that has a layer of radiation-sensitive material (resist). In general, a single substrate will contain a network of adjacent target portions that are successively exposed. Known lithographic apparatus include steppers, in which each target portion is irradiated by exposing an entire pattern onto the target portion at once, and scanners, in which each target portion is irradiated by scanning the pattern through the projection beam in a given direction (the "scanning" direction) while synchronously scanning the substrate parallel or anti-parallel to this direction. In a lithographic apparatus as described above a device for generating radiation or radiation source will be present.

In a lithographic apparatus, the size of features that can be imaged onto a substrate may be limited by the wavelength of the projection radiation. To produce integrated circuits with a higher density of devices, and hence higher operating speeds, it is desirable to be able to image smaller features. While most current lithographic projection apparatus employ ultraviolet light generated by mercury lamps or excimer lasers, it has been proposed to use shorter wavelength radiation of around 13 nm. Such radiation is termed extreme ultraviolet, also referred to as XUV or EUV, radiation. The abbreviation 'XUV' generally refers to the wavelength range from several tenths of a nanometer to several tens of nanometers, combining the soft x-ray and vacuum UV range, whereas the term 'EUV' is normally used in conjunction with lithography (EUVL) and refers to a radiation band from approximately 5 to 20 nm, i.e. part of the XUV range.

A discharge produced (DPP) source generates plasma by a discharge in a substance, for example a gas or vapor, between an anode and a cathode, and may subsequently create a high-temperature discharge plasma by Ohmic heating caused by a pulsed current flowing through the plasma. In this case, the desired radiation is emitted by the high-temperature discharge plasma. Such a device is described in European Patent Application No. 03255825.6, filed Sep. 17, 2003 in the name of the applicant. This application describes a radiation source providing radiation in the EUV range of the electromagnetic spectrum (i.e. of 5-20 nm wavelength). The radiation source includes several plasma discharge elements, and each element includes a cathode and an anode. During operation, the EUV radiation is generated by creating a pinch.

Generally, a plasma is formed by a collection of free-moving electrons and ions (atoms that have lost electrons). The energy needed to strip electrons from the atoms to make plasma can be of various origins: thermal, electrical, or light (ultraviolet light or intense visible light from a laser). More details on the pinch, the laser triggering effect and its application in a source with rotating electrodes may be found in J. Pankert, G. Derra, P. Zink, Status of Philips' extreme-UV source, SPIE Proc. 6151-25 (2006).

In addition to this radiation, the discharge source typically produces debris particles, among which can be all kinds of microparticles varying in size from atomic to complex particles up to 100 micron droplets, which can be both charged and uncharged. It is desired to limit the contamination of the optical system that is arranged to condition the beams of radiation coming from an EUV source from this debris. A problem with DPP-based EUV sources is the thermal load on the electrodes due to their close proximity to the plasma. This may become particularly relevant when scaling the EUV source to meet the specifications for a production exposure tool.

SUMMARY OF THE INVENTION

It is an aspect to provide radiation source in which harmful debris production can be reduced. The source is especially suitable for generating EUV radiation, but may be used to generate radiation outside the EUV range, for example X-rays.

According to an embodiment, there is provided a device constructed to generate radiation. The device includes a liquid bath, and a pair of electrodes. At least a part of one of the electrodes is formed by a cable part moveable with respect to the liquid bath. The device also includes an actuator arranged to move the cable part from a liquid-adhering position to an ignition position, and an ignition source configured to trigger a discharge produced radiating plasma from the liquid adherent to the cable part, when the cable part is in the ignition position, by a discharge between the electrodes. The liquid-adhering position is a position for adhering a liquid from the bath to the part of the electrode.

According to an embodiment, there is provided a lithographic apparatus that includes a radiation generator constructed and arranged to generate radiation. The radiation generator includes a liquid bath, and a pair of electrodes. At least one of the electrodes is formed by a cable part moveable with respect to the liquid bath. The radiation generator also includes an actuator arranged to move the at least one of the electrodes from a liquid-adhering position to an ignition position, and an ignition source configured to trigger a discharge produced plasma of adherent liquid between the electrodes, when the cable part is in the ignition position. The apparatus also includes an illumination system configured to condition a beam of radiation from the radiation generator, and a support configured to supporting a patterning device. The patterning device is configured to impart the beam of radiation with a pattern in its cross-section. The apparatus further includes a substrate table configured to hold a substrate, and a projection system configured to project the patterned beam onto a target portion of the substrate.

According to an embodiment, a device manufacturing method is provided. The method includes moving at least a part of a first electrode with respect to a liquid from a liquid-adhering position to an ignition position. The liquid-adhering position is a position in which the liquid adheres to the at least a part of the first electrode. The part of the first electrode is formed by a cable. The method also includes triggering a discharge produced plasma from the liquid adherent to the first electrode and a second electrode to generate a beam of radiation, when at least the part of the first electrode is in the ignition position, patterning the beam of radiation with a pattern in its cross-section, and projecting the patterned beam of radiation onto a target portion of a substrate.

According to an embodiment, there is provided a device constructed to generate radiation. The device includes a liquid bath, and a pair of electrodes. At least one of the electrodes is a movable electrode provided on a cable movable with respect to the liquid bath. The device also includes an actuator arranged to move the movable electrode from a liquid-adhering position to an ignition position, and an ignition source configured to trigger a discharge from liquid adherent to the movable electrode. The liquid adherent to the movable electrode is received by the movable electrode at the liquid-adhering position and the ignition source triggers the discharge at the ignition position.

BRIEF DESCRIPTION OF THE DRAWINGS

Embodiments of the present invention will now be described, by way of example only, with reference to the accompanying schematic drawings in which corresponding reference symbols indicate corresponding parts, and in which.

DETAILED DESCRIPTION

Figure 1:
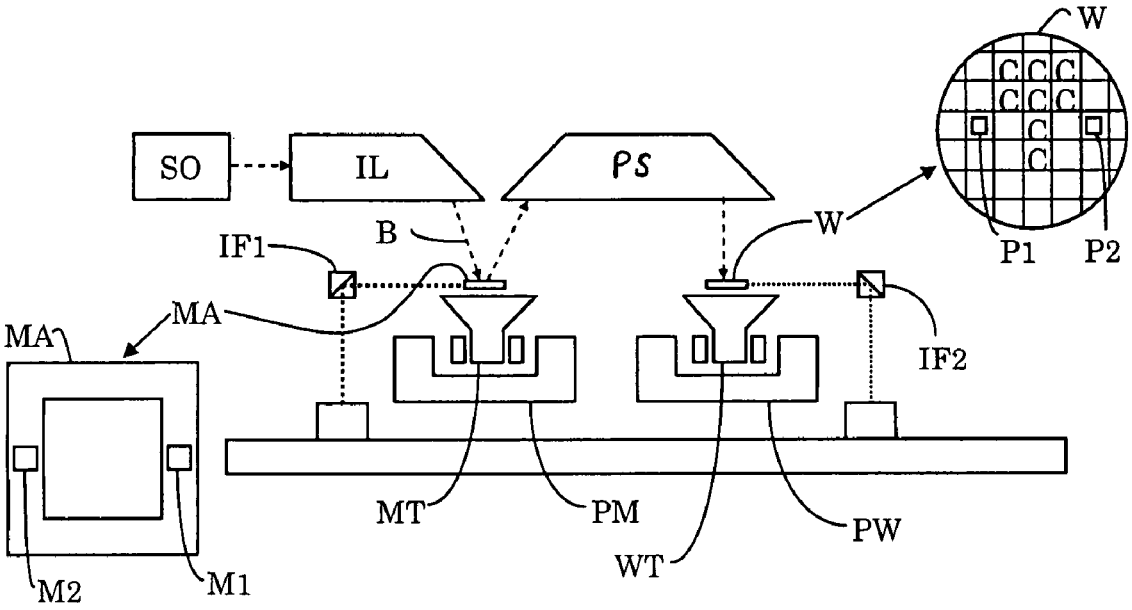
FIG. 1 depicts a lithographic apparatus according to an embodiment of the invention.

FIG. 1 schematically depicts a lithographic apparatus according to one embodiment of the invention. The apparatus comprises: an illumination system (illuminator) IL configured to condition a radiation beam B (e.g. UV radiation or EUV radiation); a support structure (e.g. a mask table) MT constructed to support a patterning device (e.g. a mask) MA and connected to a first positioner PM configured to accurately position the patterning device in accordance with certain parameters; a substrate table (e.g. a wafer table) WT constructed to hold a substrate (e.g. a resist-coated wafer) W and connected to a second positioner PW configured to accurately position the substrate in accordance with certain parameters; and a projection system (e.g. a refractive or reflective projection lens system) PS configured to project a pattern imparted to the radiation beam B by patterning device MA onto a target portion C (e.g. comprising one or more dies) of the substrate W.

The illumination and projection system may include various types of optical components, such as refractive, reflective, diffractive or other types of optical components, or any combination thereof, for directing, shaping, or controlling radiation.

The support structure supports, i.e. bears the weight of, the patterning device. It holds the patterning device in a manner that depends on the orientation of the patterning device, the design of the lithographic apparatus, and other conditions, such as for example whether or not the patterning device is held in a vacuum environment. The support structure can use mechanical, vacuum, electrostatic or other clamping techniques to hold the patterning device. The support structure may be a frame or a table, for example, which may be fixed or movable as required. The support structure may ensure that the patterning device is at a desired position, for example with respect to the projection system. Any use of the terms "reticle" or "mask" herein may be considered synonymous with the more general term "patterning device."

The term "patterning device" used herein should be broadly interpreted as referring to any device that can be used to impart a radiation beam with a pattern in its cross-section such as to create a pattern in a target portion of the substrate. It should be noted that the pattern imparted to the radiation beam may not exactly correspond to the desired pattern in the target portion of the substrate, for example if the pattern includes phase-shifting features or so called assist features. Generally, the pattern imparted to the radiation beam will correspond to a particular functional layer in a device being created in the target portion, such as an integrated circuit.

The patterning device may be transmissive or reflective. Examples of patterning devices include masks, programmable mirror arrays, and programmable LCD panels. Masks are well known in lithography, and include mask types such as binary, alternating phase-shift, and attenuated phase-shift, as well as various hybrid mask types. An example of a programmable mirror array employs a matrix arrangement of small mirrors, each of which can be individually tilted so as to reflect an incoming radiation beam in different directions. The tilted mirrors impart a pattern in a radiation beam which is reflected by the mirror matrix.

The term "projection system" used herein should be broadly interpreted as encompassing any type of projection system, including refractive, reflective, catadioptric, or any combination thereof, as appropriate for the exposure radiation being used. Any use of the term "projection lens" herein may be considered as synonymous with the more general term "projection system".

As here depicted, the apparatus is of a reflective type (e.g. employing a reflective mask). Alternatively, the apparatus may be of a transmissive type (e.g. employing a transmissive mask).

The lithographic apparatus may be of a type having two (dual stage) or more substrate tables (and/or two or more mask tables). In such "multiple stage" machines the additional tables may be used in parallel, or preparatory steps may be carried out on one or more tables while one or more other tables are being used for exposure.

Referring to FIG. 1, the illuminator IL receives a radiation beam from a radiation source SO. The source and the lithographic apparatus may be separate entities, for example when the source is an excimer laser. In such cases, the source is not considered to form part of the lithographic apparatus and the radiation beam is passed from the source SO to the illuminator IL with the aid of a beam delivery system comprising, for example, suitable directing mirrors and/or a beam expander. In other cases the source may be an integral part of the lithographic apparatus, for example when the source is a mercury lamp. The illuminator IL may comprise an adjuster for adjusting the angular intensity distribution of the radiation beam. Generally, at least the outer and/or inner radial extent (commonly referred to as s-outer and s-inner, respectively) of the intensity distribution in a pupil plane of the illuminator can be adjusted. In addition, the illuminator IL may comprise various other components, such as an integrator and a condenser. The illuminator may be used to condition the radiation beam, to have a desired uniformity and intensity distribution in its cross-section.

The radiation beam B is incident on the patterning device (e.g., mask MA), which is held on the support structure (e.g., mask table MT), and is patterned by the patterning device. Having traversed the mask MA, the radiation beam B passes through the projection system PS, which focuses the beam onto a target portion C of the substrate W. With the aid of the second positioner PW and position sensor IF2 (e.g. an interferometric device, linear encoder or capacitive sensor), the substrate table WT can be moved accurately, e.g. so as to position different target portions C in the path of the radiation beam B. Similarly, the first positioner PM and another position sensor IF1 can be used to accurately position the mask MA with respect to the path of the radiation beam B, e.g. after mechanical retrieval from a mask library, or during a scan. In general, movement of the mask table MT may be realized with the aid of a long-stroke module (coarse positioning) and a short-stroke module (fine positioning), which form part of the first positioner PM. Similarly, movement of the substrate table WT may be realized using a long-stroke module and a short-stroke module, which form part of the second positioner PW. In the case of a stepper (as opposed to a scanner) the mask table MT may be connected to a short-stroke actuator only, or may be fixed. Mask MA and substrate W may be aligned using mask alignment marks M1, M2 and substrate alignment marks P1, P2. Although the substrate alignment marks as illustrated occupy dedicated target portions, they may be located in spaces between target portions (these are known as scribe-lane alignment marks). Similarly, in situations in which more than one die is provided on the mask MA, the mask alignment marks may be located between the dies.

The depicted apparatus could be used in at least one of the following modes:

1. In step mode, the mask table MT and the substrate table WT are kept essentially stationary, while an entire pattern imparted to the radiation beam is projected onto a target portion C at one time (i.e. a single static exposure). The substrate table WT is then shifted in the X and/or Y direction so that a different target portion C can be exposed. In step mode, the maximum size of the exposure field limits the size of the target portion C imaged in a single static exposure.

2. In scan mode, the mask table MT and the substrate table WT are scanned synchronously while a pattern imparted to the radiation beam is projected onto a target portion C (i.e. a single dynamic exposure). The velocity and direction of the substrate table WT relative to the mask table MT may be determined by the (de-)magnification and image reversal characteristics of the projection system PS. In scan mode, the maximum size of the exposure field limits the width (in the non-scanning direction) of the target portion in a single dynamic exposure, whereas the length of the scanning motion determines the height (in the scanning direction) of the target portion.

3. In another mode, the mask table MT is kept essentially stationary holding a programmable patterning device, and the substrate table WT is moved or scanned while a pattern imparted to the radiation beam is projected onto a target portion C. In this mode, generally a pulsed radiation source is employed and the programmable patterning device is updated as required after each movement of the substrate table WT or in between successive radiation pulses during a scan. This mode of operation can be readily applied to maskless lithography that utilizes programmable patterning device, such as a programmable mirror array of a type as referred to above.

Combinations and/or variations on the above described modes of use or entirely different modes of use may also be employed.

Referring to the radiation source SO in FIG. 1, a typical (Sn-based) plasma discharge sources consists of two slowly rotating wheels on which liquid Sn is continuously applied, e.g. by partly immersing them in a liquid Sn bath as discussed in Pankert cited hereabove. The wheels act as electrodes and a discharge is established at the point where the wheels are closest to one another. With the application of this type of source in an EUV exposure tool, proper mitigation and/or cleaning schemes for Sn debris, e.g. rotating foil traps, reflective foil traps, directional gas flows, cleaning with hydrogen radicals or a combination thereof are typically included. Instead of an Sn based plasma source, several other fuel sources may be used to generate EUV radiation at a wavelength of 13.5 nm, including Xe, Li and Sn. Sn is often used for production tool specifications because of its high conversion efficiency. However, Sn sources also emit a relatively high amount of debris that should be mitigated and/or cleaned in order to maintain an acceptable lifetime of the optics in the lithographic system. In the prior art systems as disclosed by Pankert, fast atomic debris and ballistic microparticles pose a significant challenge since they travel approximately parallel to the optical path and are therefore difficult to capture.

Figure 2A:
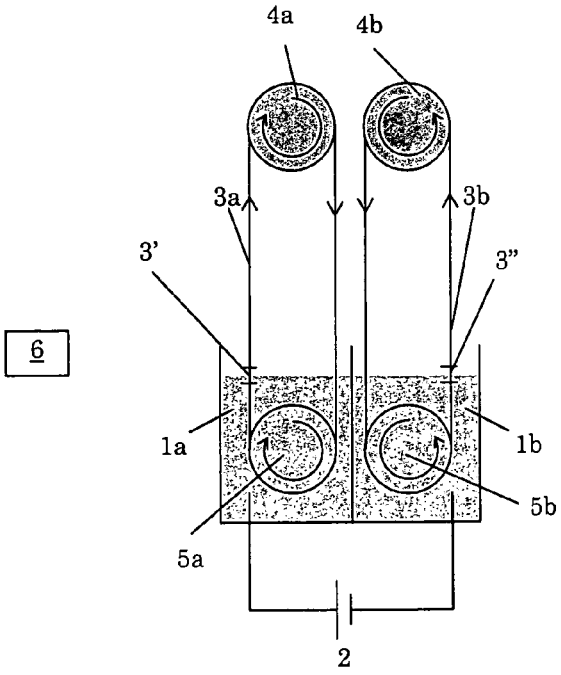
FIG. 2 depicts a schematic front view of an embodiment of a device according to the present invention.
Figure 2B:
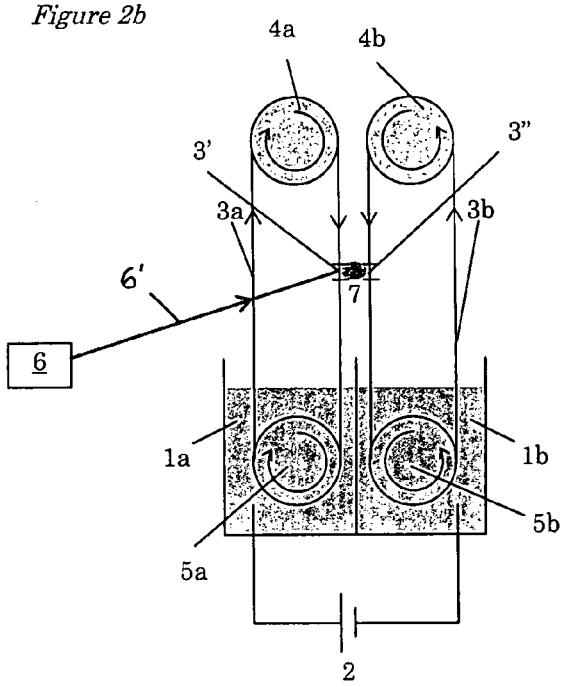

FIGS. 2*a* and 2*b* schematically show the source SO of FIG. 1 in more detail. In this embodiment, two baths 1*a*, 1*b* of liquid, in particular liquid Sn, are shown, electrically insulated from one another. A high voltage is applied across the baths 1*a*, 1*b* by a capacitor bank/charger 2. In this embodiment, through each of the baths 1*a*, 1*b*, a cable electrode 3*a*, 3*b* runs on reels 4*a*, 4*b*, 5*a*, 5*b*—one reel 4*a*, 4*b* suspended above the baths and one reel 5*a*, 5*b* fully immersed in the baths, as can clearly be seen in FIGS. 2*a* and 2*b*. In this embodiment, both of the cable electrodes 3*a*, 3*b* are formed as closed loops. Alternatively, it may be feasible to provide a single cable electrode in conjunction with a fixed electrode or a slowly revolving conventional electrode as explained hereabove with respect to the Pankert publication, in particular, when the plasma is created in the vicinity of the cable.

Cable parts 3', 3" are each indicated in FIGS. 2*a* and 2*b* by the lines perpendicular to the cables 3*a*, 3*b* and the reference numerals 3' and 3". The lines perpendicular to the cables 3*a*, 3*b* are only meant to schematically indicate the cable parts 3', 3". In the illustrated embodiment, liquid Sn can adhere to cable parts 3', 3" of the cable loops as the cable parts 3', 3" emerge from the baths (FIG. 2*a*). At an ignition position where both cable parts 3', 3" are separated by typically a few millimeters, Sn is evaporated from one of the cables by a laser beam emanating from the laser 6 (FIG. 2*b*). The laser 6 functions as an ignition source configured to trigger a discharge produced radiating plasma from fluid adherent to the electrode, by a discharge between the two cables electrodes 3*a*, 3*b*. A discharge is subsequently established through the Sn vapor, thereby resulting in a Sn plasma 7 that emits EUV radiation. The cable electrodes 3*a*, 3*b* may be wound around the lower reel 5*a*, 5*b* an arbitrary number of times to provide the desired cooling effect. Alternatively, a number of reels (not shown) may be immersed in the fluid to guide the cable through the fluid across a predetermined distance. Typically, the distance is predetermined in conjunction with a typical cable speed, in order to allow the cable to be immersed sufficiently long enough in the liquid to provide proper cooling. Motion of the cable parts 3', 3" is achieved by rotating either the lower or the upper reels via an external rotation mechanism (not shown in the Figures).

In particular, the cables can be moved so that the cable parts 3', 3" which are facing each other both move into the fluid baths 1*a* and 1*b*. Alternatively, motion of these parts 3', 3" can be inversed to move the cable out of said fluid bath. Combinations of up and downwards velocity directions are feasible. A possible advantage of a downward direction is the immediate cooling of the cable through the liquid in the liquid bath. An advantage of an upward direction may be an improved adherence of the liquid to the cable.

Figure 3:
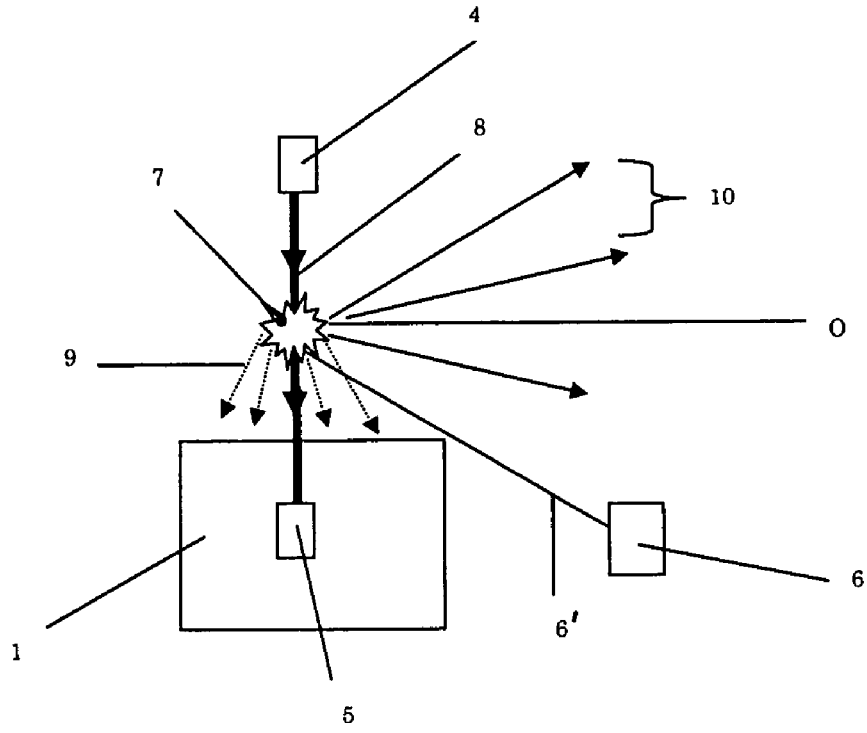
FIG. 3 depicts a schematic side view of the device of FIG. 2.

FIG. 3 illustrates a side view of the embodiment viewed in FIG. 2. Typically, the directions of cable movement are in a direction generally parallel to a direction of gravity. Due to the straight line trajectories of the cable movement in the area where plasma 7 is created, a predominant direction of movement of debris 9 is provided, which makes it easier to trap the debris 9 in the liquid bath 1. In addition, since the direction of movement is given a velocity component perpendicular to the optical axis O, debris traveling in the direction of the optical axis O (typically, in FIG. 2, in an out of plane direction) will be less likely to occur.

In order that a self-inductance is in a range of less than 15 nH, the pinch may be located fairly close (~10 mm) to the liquid surface in order to give an acceptable self-inductance: for a loop of 5 mm×10 mm with a wire radius of 0.4 mm, an inductance can be calculated to be L=12.3 nH. Increasing the wire radius may reduce the self-inductance. For example, a 1 mm wire will have L=6.8 nH.

In the proposed setup, any debris 9 generated by the discharge is given a velocity component parallel to the cable electrodes 3*a*, 3*b*. This may allow for effective mitigation of debris microparticles, which typically have a ballistic velocity between about 10 and about 100 m/s. By letting the cable electrodes 3*a*, 3*b* run at a velocity of the same order, e.g. about 50 m/s, such particles are effectively traveling outside a collection angle of the collection optics directed towards the bath 1 and thus do not contaminate the collecting optics (not shown) provided along optical axis O.

Furthermore, a foil trap with platelets (not shown) functioning as a contamination barrier may be employed, in order to further suppress the debris particles 9. In addition, due to the fact that the debris particles now have a velocity in the direction of the wire movement, a large part of the debris particles will travel in a direction outside a collection angle of the collection optics.

Typically, the Sn bath will be cooler (for example: below 300° C.) than the electrode (typically up to 800° C.) and will therefore provide substantial cooling by conduction. To calculate the temperature change of the heated cable as it travels through the bath, it may be assumed that the outside of the cable is continuously kept at the average temperature of the bath. This is a reasonable assumption given the high velocity of the cable and the relatively high thermal diffusivity of Sn ($\sim 4\cdot 10^{-4} m^2/s$).

Assuming that the cable has a uniform temperature $T_0$ throughout its cross section when it enters the bath with temperature $T_b$, the temperature inside the cable at a radial position r and time t is given by $$T(r,t) = T_0 + (T_b - T_0)\left(1 - 2\sum_{n=1}^{\infty} \frac{J_0(\alpha_n r/a)}{\alpha_n J_1(\alpha_n)} \exp\left(\frac{-\alpha_n^2 \kappa t}{a}\right)\right)$$

where $\alpha$ is the radius of the cable, $\kappa$ is the thermal diffusivity of the cable, $J_n(z)$ is the nth order Bessel function of the first kind and $\alpha$ is the nth positive zero of $J_0(z)$.

Figure 4:
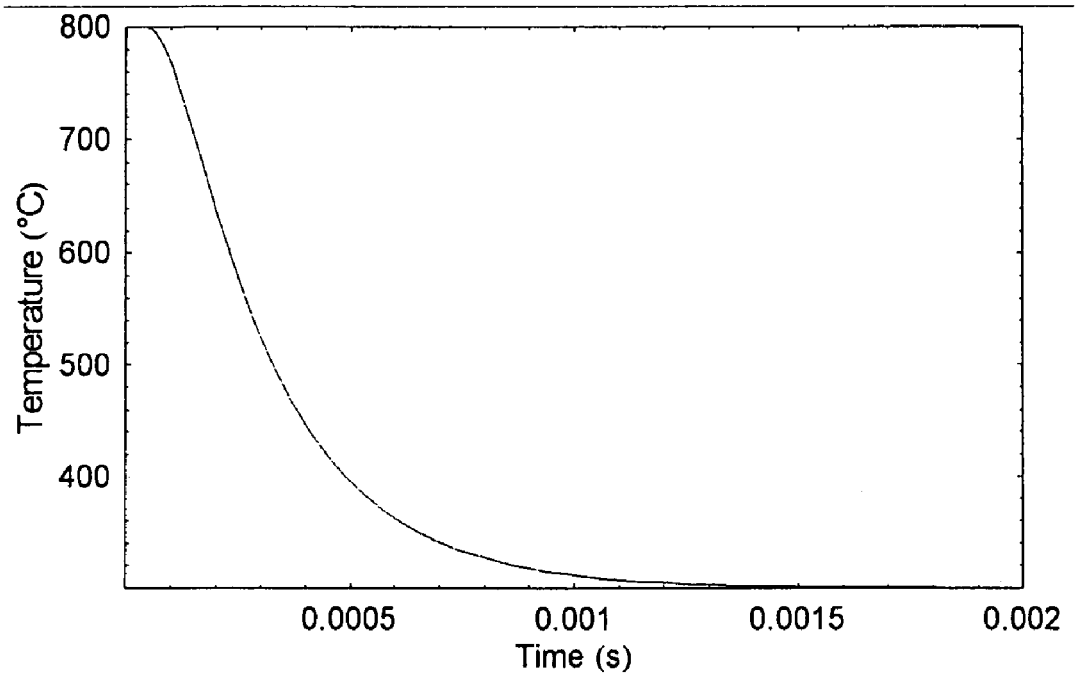
FIG. 4 shows a chart indicative of cooling behavior of an embodiment according to the invention.

FIG. 4 shows a temperature drop at the center of a molybdenum cable with diameter 0.5 mm and initial temperature 800° C. after immersion in a conducting environment of 300° C. In particular, the core temperature (i.e. at r=0) for a molybdenum cable as a function of time for typical parameters $\alpha$=0.25 mm, $T_0$=800° C. and $T_b$=300° C. At 1 ms after immersion, the cable core has reached a temperature of 311° C., i.e. it has approached the bath temperature to within 2% of the initial temperature difference. In order to accomplish this temperature drop at a typical cable velocity of about 50 m/s, the distance the cable travels in the bath should be of the order of about 5 cm. Such a distance can be realized with a single winding of the cable around the lower reel 5*a*, 5*b*. Further cooling can be achieved with extra windings around the lower reel 5*a*, 5*b* as mentioned earlier.

While FIG. 4 shows an example of molybdenum as cable material, other types of materials may be used. In particular, fibers or fiber-reinforced materials can undergo very high (anisotropic) elastic strains provided they have sufficient thermal stability and may therefore suitably be used as cable material. Also, in view of relative high temperatures, refractory metals such as molybdenum or tungsten may be considered as a cable material. In practice, a cable consisting of braided metal wires may be used, which may reduce the overall bending strain in the cable. Alternatively, the cable may be a chain consisting of metal links. A typical dimension of the cable diameter may be ranging between 0.1 and 2 mm.

The energy per pulse Q may be between approximately 10 and 100 mJ for a Sn discharge and between approximately 1 and 10 mJ for a Li discharge, and the duration of the pulse may be between approximately 1 and 100 ns, the laser wavelength may be between 0.2 and 10 μm, and the frequency may be between approximately 5 and 100 kHz. The laser 6 produces a laser beam 6' directed to a cable 8, which extends between reels 4 and 5, to ignite the adherent fluid from liquid bath 1. Adhered fluid material on the cable 8 is evaporated and pre-ionized at a well-defined location, i.e. the location where the laser beam 6' hits the cable 8. From that location, a discharge 7 towards the cable 8 develops. The precise location of the discharge 8 can be controlled by the laser 6. This is desirable for the stability, i.e. homogeneity, of the radiation generating device and will have an influence on the constancy of the radiation power of the radiation generating device. This discharge 7 generates a current between the cable 3*a* and the cable 3*b*. The current induces a magnetic field. The magnetic field generates a pinch, or compression, in which ions and free electrons are produced by collisions. Some electrons will drop to a lower band than the conduction band of atoms in the pinch and thus produce radiation 10. When the fluid material is chosen from Ga, Sn, In or Li or any combination thereof, the radiation 10 includes large amounts of EUV radiation. The radiation 10 emanates in all directions and may be collected by a radiation collector in the illuminator IL of FIG. 1. In an embodiment, the laser 6 may provide a pulsed laser beam.

The radiation 10 is isotropic at least at angles to a Z-axis with an angle θ=45-105°. The Z-axis refers to the axis aligned with the pinch and going through the cables 3*a*, 3*b* and the angle θ is the angle with respect to the Z-axis. The radiation 10 may be isotropic at other angles as well. The cables 3*a*, 3*b* may have a circular cross-section of between about 0.1. and about 2 mm in diameter. In addition, it may be desirable to employ one or both cables 3*a*, 3*b* with a flat surface, for example in the form of a ribbon.

Although specific reference may be made in this text to the use of lithographic apparatus in the manufacture of ICs, it should be understood that the lithographic apparatus described herein may have other applications, such as the manufacture of integrated optical systems, guidance and detection patterns for magnetic domain memories, flat-panel displays, liquid-crystal displays (LCDs), thin-film magnetic heads, etc. The skilled artisan will appreciate that, in the context of such alternative applications, any use of the terms "wafer" or "die" herein may be considered as synonymous with the more general terms "substrate" or "target portion", respectively. The substrate referred to herein may be processed, before or after exposure, in for example a track (a tool that typically applies a layer of resist to a substrate and develops the exposed resist), a metrology tool and/or an inspection tool. Where applicable, the disclosure herein may be applied to such and other substrate processing tools. Further, the substrate may be processed more than once, for example in order to create a multi-layer IC, so that the term substrate used herein may also refer to a substrate that already contains multiple processed layers.

In the embodiments described above, both the anode and cathode are provided as a conductive cable. However, the anode may be a fixed anode. Ignition of the discharge between the cables 3*a* and 3*b* is described above as being triggered by the laser beam 6'. However, such an ignition may be triggered by an electron beam, or any other suitable ignition source.

The term "lens", where the context allows, may refer to any one or combination of various types of optical components, including refractive, reflective, magnetic, electromagnetic and electrostatic optical components.

The descriptions above are intended to be illustrative, not limiting. Thus, it will be apparent to one skilled in the art that modifications may be made to the invention as described without departing from the scope of the claims set out below.

What is claimed is:

1. A device constructed to generate radiation, the device comprising:

a liquid bath;

a pair of electrodes, at least a part of one of the electrodes being formed by a cable part moveable with respect to the liquid bath;

an actuator arranged to move said cable part from a liquid-adhering position to an ignition position outside of the liquid bath; and an ignition source configured to trigger a discharge produced radiating plasma from the liquid adherent to the cable part, when the cable part is in the ignition position, by a discharge between the electrodes, wherein the liquid-adhering position is a position for adhering a liquid from said bath to the part of the electrode.

2. A device according to claim 1, wherein said actuator is arranged to move said cable into said liquid bath for bringing the cable part to the liquid-adhering position.

3. A device according to claim 1, wherein said actuator is arranged to move said cable out of said liquid bath for bringing the cable part to the ignition position.

4. A device according to claim 1, wherein at least part of the cable is moveable in a direction along a straight line trajectory.

5. A device according to claim 1, wherein said cable is formed as a closed loop wound around a lower reel immersed in the liquid.

6. A device according to claim 5, wherein the cable is wound around the lower reel several times.

7. A device according to claim 5, wherein the cable is wound around an upper reel suspended above the liquid.

8. A device according to claim 7, wherein said cable is moveable by rotation of at least one of said lower and upper reels.

9. A device according to claim 1, wherein said cable has a circular cross-section with a diameter ranging between about 0.1 and about 2 mm.

10. A device according to claim 1, wherein said cable has at least one flat surface.

11. A device according to claim 1, wherein said cable is formed by a plurality of braided wires or a plurality of links.

12. A device according to claim 1, further comprising a contamination baffler comprising a plurality of platelets.

13. A device according to claim 1, wherein the ignition source is configured to generate a beam of laser radiation and/or an electron beam to trigger the discharge.

14. A device according to claim 1, wherein the liquid comprises tin, or gallium, or indium, or lithium, or any combination thereof.

15. A device according to claim 1, wherein at least a part of each electrode is formed by a cable part, respectively.

16. A lithographic apparatus, comprising:

a radiation generator constructed and arranged to generate radiation, the radiation generator comprising a liquid bath, a pair of electrodes, wherein at least one of the electrodes is formed by a cable part moveable with respect to the liquid bath, an actuator arranged to move the at least one of the electrodes from a liquid-adhering position to an ignition position, and an ignition source configured to trigger a discharge produced plasma of adherent liquid between the electrodes, when the cable part is in the ignition position;

an illumination system configured to condition a beam of radiation from the radiation generator;

a support configured to supporting a patterning device, the patterning device being configured to impart the beam of radiation with a pattern in its cross-section;

a substrate table configured to hold a substrate; and a projection system configured to project the patterned beam onto a target portion of the substrate.

17. An apparatus according to claim 16, wherein the liquid comprises tin, or gallium, or indium, or lithium, or any combination thereof.

18. A device manufacturing method, comprising:

moving at least a part of a first electrode with respect to a liquid from a liquid-adhering position to an ignition position, wherein the liquid-adhering position is a position in which the liquid adheres to said at least a part of the first electrode, the part of the first electrode being formed by a cable;

triggering a discharge produced plasma from the liquid adherent to said first electrode and a second electrode to generate a beam of radiation, when at least the part of the first electrode is in the ignition position;

patterning the beam of radiation with a pattern in its cross-section; and projecting the patterned beam of radiation onto a target portion of a substrate.

19. A method according to claim 18, wherein said cable is moved at a speed ranging between about 10 and about 100 m/s.

20. A method according to claim 18, wherein the cable is kept immersed in the fluid in a time span ranging between about 0.05 and about 15 milliseconds.

21. A device manufactured by the method of claim 18.

22. A device constructed to generate radiation, comprising:

a liquid bath;

a pair of electrodes, at least one of the electrodes being a movable electrode provided on a cable movable with respect to the liquid bath;

an actuator arranged to move the movable electrode from a liquid-adhering position to an ignition position; and an ignition source configured to trigger a discharge from liquid adherent to the movable electrode, which liquid adherent to the movable electrode is received by the movable electrode at the liquid-adhering position and the ignition source triggers the discharge at the ignition position.

23. A device according to claim 22, wherein both electrodes are formed on respective cables.

24. A device according to claim 22, wherein both electrodes are movable, and further comprising a second actuator arranged to move the other movable electrode.

25. A device according to claim 22, wherein both electrodes are movable, and wherein the actuator is further arranged to mover the other movable actuator.

26. A device according to claim 22, wherein the electrodes are each attached to a respective cable.

* * * * *